US010945469B1

(12) United States Patent
Rosenberg et al.

(10) Patent No.: US 10,945,469 B1
(45) Date of Patent: Mar. 16, 2021

(54) RESPIRATOR

(71) Applicant: Grove Biomedical LLC, Waccabuc, NY (US)

(72) Inventors: Joseph Rosenberg, Waccabuc, NY (US); Qing Xiang Yee, Singapore (SG); Joshua Boggs, Aledo, TX (US); Adam Pozdro, Libertyville, IL (US); Benjamin Frothingham, Merrimack, NH (US); Douglas Clift, Denver, CO (US)

(73) Assignee: Grove Biomedical LLC, Waccabuc, NY (US)

( * ) Notice: Subject to any disclaimer, the term of this patent is extended or adjusted under 35 U.S.C. 154(b) by 0 days.

(21) Appl. No.: 16/918,702

(22) Filed: Jul. 1, 2020

Related U.S. Application Data

(60) Provisional application No. 63/034,933, filed on Jun. 4, 2020.

(51) Int. Cl.
*A62B 23/02* (2006.01)
*A41D 13/11* (2006.01)
(Continued)

(52) U.S. Cl.
CPC ..... *A41D 13/1161* (2013.01); *A41D 13/0002* (2013.01); *A62B 7/10* (2013.01);
(Continued)

(58) Field of Classification Search
CPC .. A61M 2210/0606; A61M 2210/0618; A62B 18/00; A62B 18/003; A62B 18/02; A62B 18/025; A62B 7/10; A62B 18/04; A62B 18/045; A62B 18/06; A62B 18/08; A62B 18/084; A62B 23/02; A62B 23/00;
(Continued)

(56) References Cited

U.S. PATENT DOCUMENTS 2,798,483 A * 7/1957 Kashima ..... A62B 18/10 128/206.15
2,928,387 A * 3/1960 Layne ..... A61M 16/0605 128/201.19
(Continued)

FOREIGN PATENT DOCUMENTS

WO WO-2017146382 A1 * 8/2017 ..... A62B 18/08

OTHER PUBLICATIONS

English translation for WO2017/146382, espacenet.com, translated on Jan. 8, 2021.*
(Continued)

*Primary Examiner* — Tu A Vo
(74) *Attorney, Agent, or Firm* — United IP Counselors, LLC

(57) ABSTRACT

A respirator mask. The respirator mask has a filter that extends around at least a portion of the perimeter of the mask itself, leaving a central area that coincides with the position of the wearer's mouth unobstructed. A front panel of the mask may be transparent over at least the central area in order to allow the mouth to be seen while the mask is worn. The filter may be a pleated particulate filter, a chemical/gas filter, or a filter of mixed type. The front panel may also include other features, like a port for a drinking straw. The respirator mask may include headgear.

12 Claims, 10 Drawing Sheets

(51) Int. Cl.

| | |
|---|---|
| ***A62B 7/10*** | (2006.01) |
| ***A62B 18/08*** | (2006.01) |
| ***A41D 13/00*** | (2006.01) |
| ***A62B 18/02*** | (2006.01) |

(52) U.S. Cl.
CPC ..... *A62B 18/02* (2013.01); *A62B 18/08* (2013.01); *A62B 23/02* (2013.01)

(58) Field of Classification Search
CPC ..... A62B 23/025; A62B 7/00; A41D 13/1161; A41D 13/0002
See application file for complete search history.

(56) References Cited

U.S. PATENT DOCUMENTS 4,898,311 A * 2/1990 Boyer ..... A45F 5/00 224/257
6,497,232 B2 * 12/2002 Fecteau ..... A62B 18/084 128/207.11
7,036,508 B2 * 5/2006 Kwok ..... A61M 16/0633 128/207.11
9,457,207 B2 10/2016 Waterford
2004/0221849 A1 * 11/2004 Shue ..... A62B 18/025 128/206.17
2006/0230485 A1 * 10/2006 Lee ..... A41D 13/1176 2/15
2012/0234319 A1 * 9/2012 Eifler ..... A61M 16/0683 128/202.27
2014/0216476 A1 * 8/2014 Brace ..... A44B 11/2592 128/863
2015/0047642 A1 * 2/2015 Tucker ..... A62B 18/025 128/206.17
2015/0053206 A1 * 2/2015 Seppala ..... A62B 18/025 128/202.27
2016/0030779 A1 * 2/2016 Twu ..... A62B 7/10 128/202.13
2017/0007861 A1 * 1/2017 Parham ..... A62B 18/025
2017/0119106 A1 * 5/2017 Leslie ..... A01K 27/005

OTHER PUBLICATIONS

Peters, Adele. "This reusable mask is designed to fix the 28 major problems with the N95," Fast Company. Internet. Available at https://www.fastcompany.com/90542976/this-reusable-mask-is-designed-to-fix-the-28-major-problems-with-the-n95?partner=rss&utm_source=rss&utm_medium=feed&utm_campaign=rss+fastcompany&utm_content=rss, Aug. 24, 2020.

* cited by examiner

RESPIRATOR

CROSS-REFERENCE TO RELATED APPLICATIONS

This application claims priority to U.S. Provisional Application No. 63/034,933, filed Jun. 4, 2020, the contents of which are incorporated by reference in their entirety.

TECHNICAL FIELD

The invention relates to respirators.

BACKGROUND

A respirator is a safety device that allows wearers to work in environments where respiratory hazards exist in the air. These devices are essentially face masks with filters that filter out respiratory hazards. Half-face respirator masks are worn over the nose and mouth; full-face respirator masks may be worn in situations in which it is also desirable to protect the eyes. Particulate respirators are intended to filter out small particles from the air. Chemical vapor and gas respirators may filter, absorb, or inactivate chemical compounds present in the air. Most respirators do not supply oxygen on their own and are thus suitable only for environments in which sufficient oxygen exists to sustain human life, although some respirators do include, or can be coupled to, self-contained breathing apparatuses.

Respirator masks are worn in a wide variety of industrial settings to deal with a wide variety of particulate, chemical, and other hazards. In the United States, the National Institute for Occupational Safety and Health (NIOSH) promulgates standards for industrial respirators. Some respirators are also certified by the United States Food and Drug Administration (FDA) for use in medical settings to protect against bodily fluids and communicable diseases. One of the most common types of respirator is the N95 particulate respirator, which is referred to as such because it is certified to filter at least 95% of airborne particles. The N95 respirator mask is not resistant to oils and greases, although similarly-efficient respirator masks that are resistant to oils and greases are available. N95 and similar respirator masks may be either disposable (e.g., made of a fine mesh of synthetic polymer fibers) or reusable (e.g., a face-fitting half-mask or full-mask component with replaceable filter cartridges). Disposable respirator masks are more frequently used in medical settings.

In late 2019, the SARS-CoV-2 virus began to sweep through the world. In the resulting pandemic of COVID-19 disease, N95 masks and their functional equivalents across the world came to the fore as basic personal protective equipment (PPE), both for medical professionals and for the public at large. Once used only in a relatively small subset of industrial and medical occupations, these masks are now familiar to large swaths of the population, who wear them for extended periods of time. Whereas medical professionals may once have donned particulate respirator masks only for particular procedures, or to examine patients suspected of having particularly communicable diseases, in fighting the pandemic, many medical professionals have worn these masks all day, often without a break.

Extended use in a vastly expanded group of people has made clear the strengths and weaknesses of traditional respirator masks. For example, while they are effective at slowing the spread of disease, because they cover the nose and mouth, traditional respirators inhibit communication by muffling the voice and making it impossible to see the lips.

Such communication difficulties can adversely affect patient care. Additionally, medical practitioners traditionally use disposable respirators, and it is unclear at the time of writing whether, or under what conditions, disposable respirators can be safely re-used. Finally, while N95 masks are effective at filtration, the airflow restriction and pressure drop imposed by these masks can make it difficult to breathe while wearing them, particularly during any physical activity that increases oxygen demand.

BRIEF SUMMARY

One aspect of the invention relates to respirator masks. Respirator masks according to this aspect of the invention include a sealing structure that is configured and adapted to make a seal against the face. A filter is coupled to the sealing structure and arranged to extend around at least a portion of the perimeter or periphery of the mask portion of the respirator mask, leaving a central area that coincides with at least the wearer's mouth open and unobstructed. The filter medium itself may be a pleated particulate filter, and it may be carried within a filter cartridge that is designed to be disposable. In some embodiments, the mask portion may also have a transparent front plate over the central area, allowing at least the wearer's mouth to be visualized. A strap or straps are provided to hold the mask portion in place against the wearer's face.

Masks according to this aspect of the invention may also have a variety of features designed for convenience and ease of use, including a port or ports through which a straw can be inserted for refreshment and a visible indication of the wearer's identity or role.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
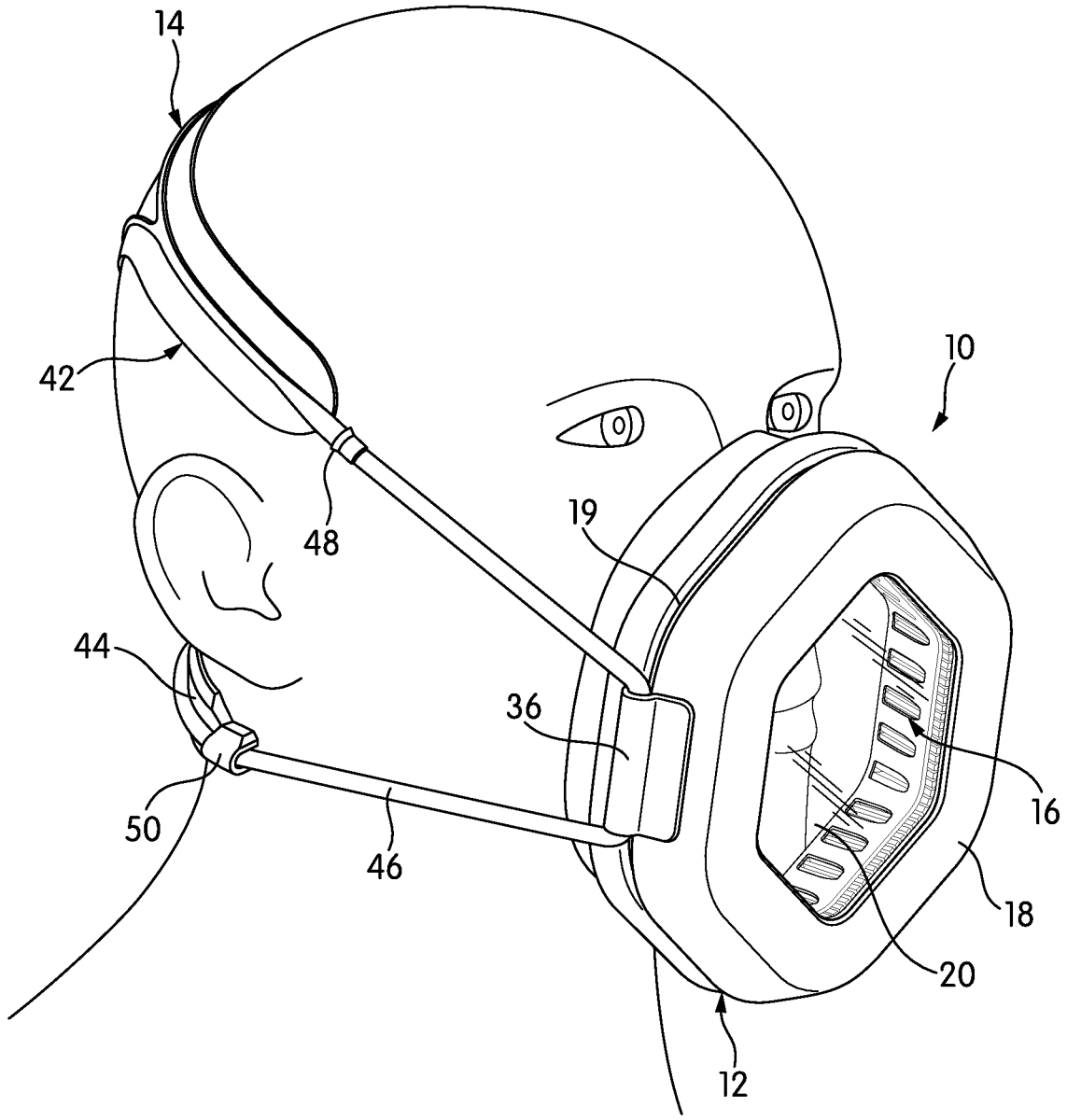
FIG. 1 is a perspective view of a respirator mask according to one embodiment of the invention, shown as installed on a wearer.

FIG. 1 is a perspective view of a respirator mask, generally indicated at 10, according to one embodiment of the invention. In FIG. 1, the respirator mask 10 is shown on the head of a wearer. The respirator mask 10 of FIG. 1 is a half-face mask, although full face masks may be made in other embodiments of the invention. The respirator mask 10 has a mask portion 12, which makes a seal against the face and filters incoming and outgoing air, and headgear 14, which secures the mask portion 12 in place on the face.

In contrast to traditional half-face masks, the mask portion 12 is structured and arranged so that it muffles the voice as little as possible and, in at least some embodiments, allows for visualization of the mouth. In particular, as will be described below in more detail, the filter cartridge 16 of the mask portion 12 is arranged to extend around the perimeter or periphery of the mask portion 12, leaving a direct, open path from the mouth to the bezel 18 that defines the front of the mask portion 12. Additionally, the mask portion 12 of this embodiment has a clear front panel 20 that allows for visualization of the mouth. The clear front panel 20, may include ports for drinking straws and other such things that would allow the wearer to take a drink or obtain other such refreshment without having to remove the respirator mask 10. The bezel 18 may include other features as well, including an identification tag or other indication of the wearer's identity or role.

Although a transparent front panel 20 is advantageous in that it allows the mouth to be visualized, respirators according to embodiments of the invention need not all have a transparent front panel 20. Even if the front panel 20 is entirely opaque, made of an opaque plastic or metal, the direct, open path between the mouth and the bezel 18 may allow certain benefits, including reduced muffling of the voice.

Figure 2:
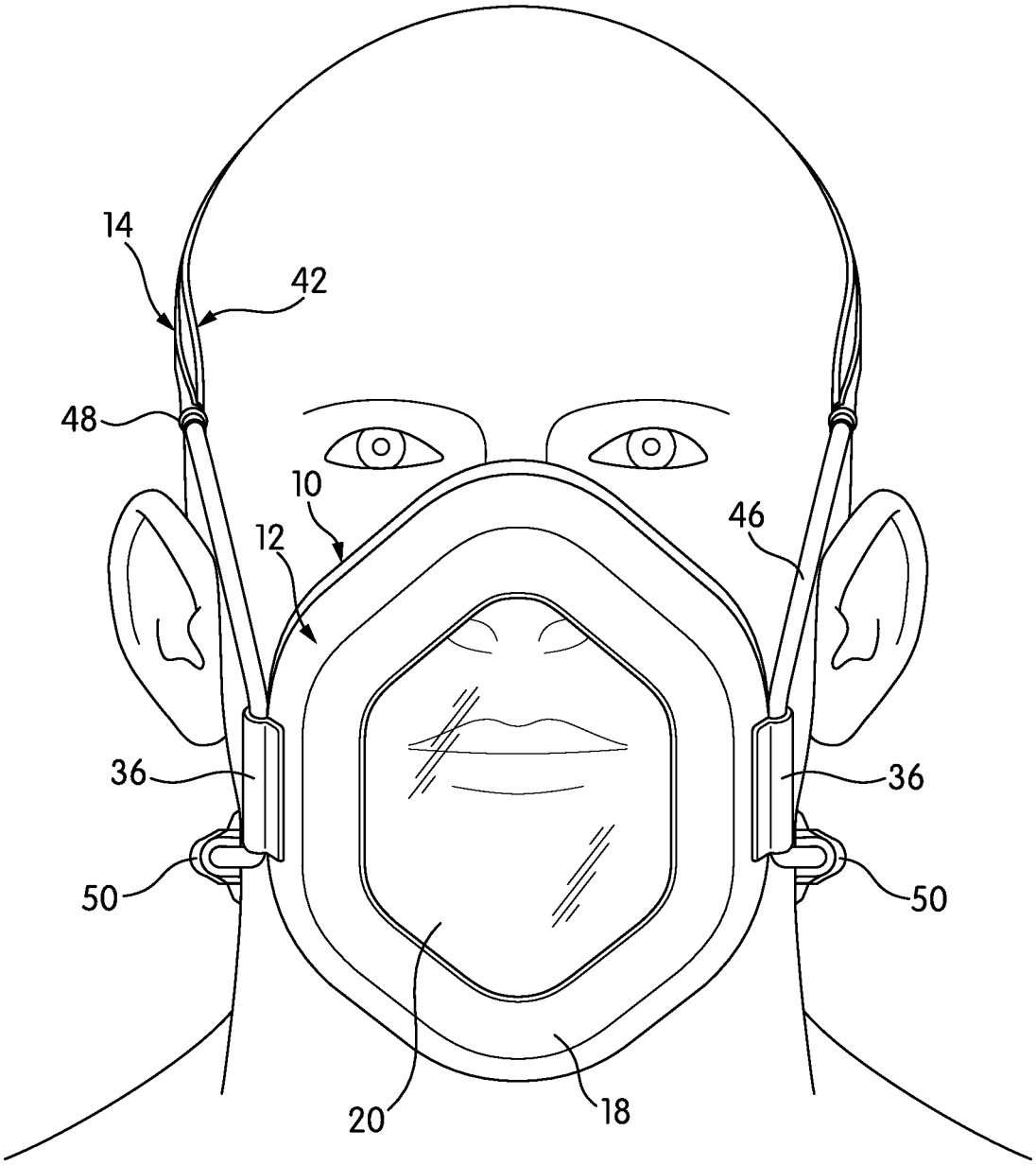
FIG. 2 is a front elevational view of the respirator mask of FIG. 1, shown as installed on the face of a wearer.

FIG. 2 is a front elevational view of the respirator mask 10, shown as worn on the head of a wearer. The mask portion 12 of the respirator mask 10 is roughly hexagonal in overall shape, with rounded corners. As was described briefly above, the filter cartridge 16 and other components are arranged to traverse the perimeter or periphery of the mask portion 12, leaving the central area of the mask portion 12 open. As will be described below in more detail, the mask portion 12 of the respirator 10 may assume other shapes.

Figure 3:
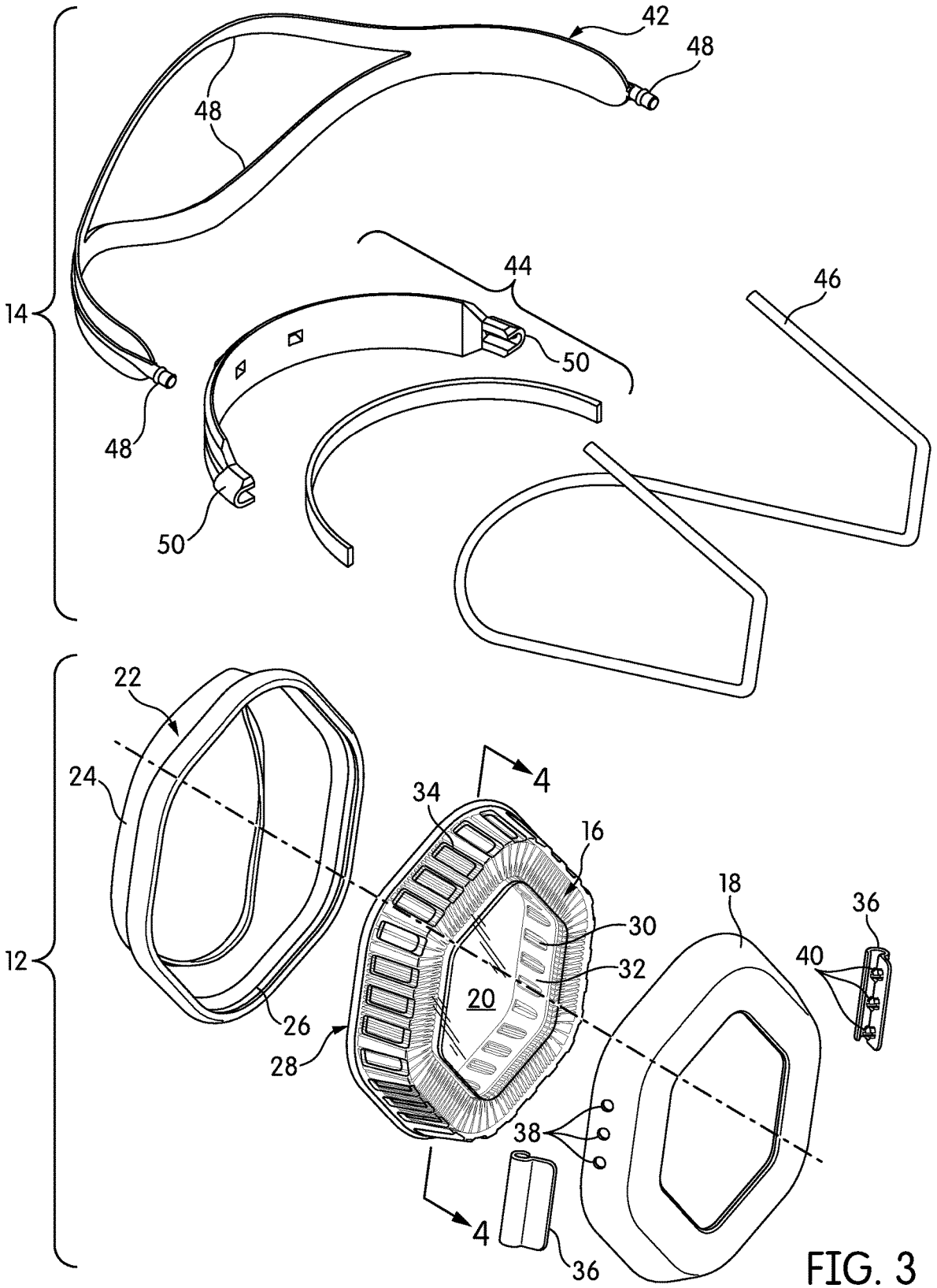
FIG. 3 is an exploded perspective view of the respirator mask of FIG. 1.

FIG. 3 is an exploded view of the respirator mask 10, including both the mask portion 12 and the headgear 14. The mask portion 12 has three major parts: an inner seal 22, a filter cartridge 16, and the bezel 18. All three parts 16, 18, 22 have a generally hexagonal-annular shape that leaves their centers open. The inner seal 22 would typically be made of a soft, resilient elastomer, such as a silicone, a thermoplastic urethane, or another type of thermoplastic elastomer. The rearward side of the inner seal 22 has a lip 24 that makes a seal around the face; the forward side of the inner seal 22 has groove structure 26 that accepts the filter cartridge 16.

The filter cartridge 16 itself has three parts, which are joined together as one in the view of FIG. 3. An inner frame 28 provides a base for the filter cartridge 16. The filter medium 30 rests overtop the inner frame 28. An outer frame 32, typically a cast or molded component, covers the filter medium 30 and protects it.

Figure 4:
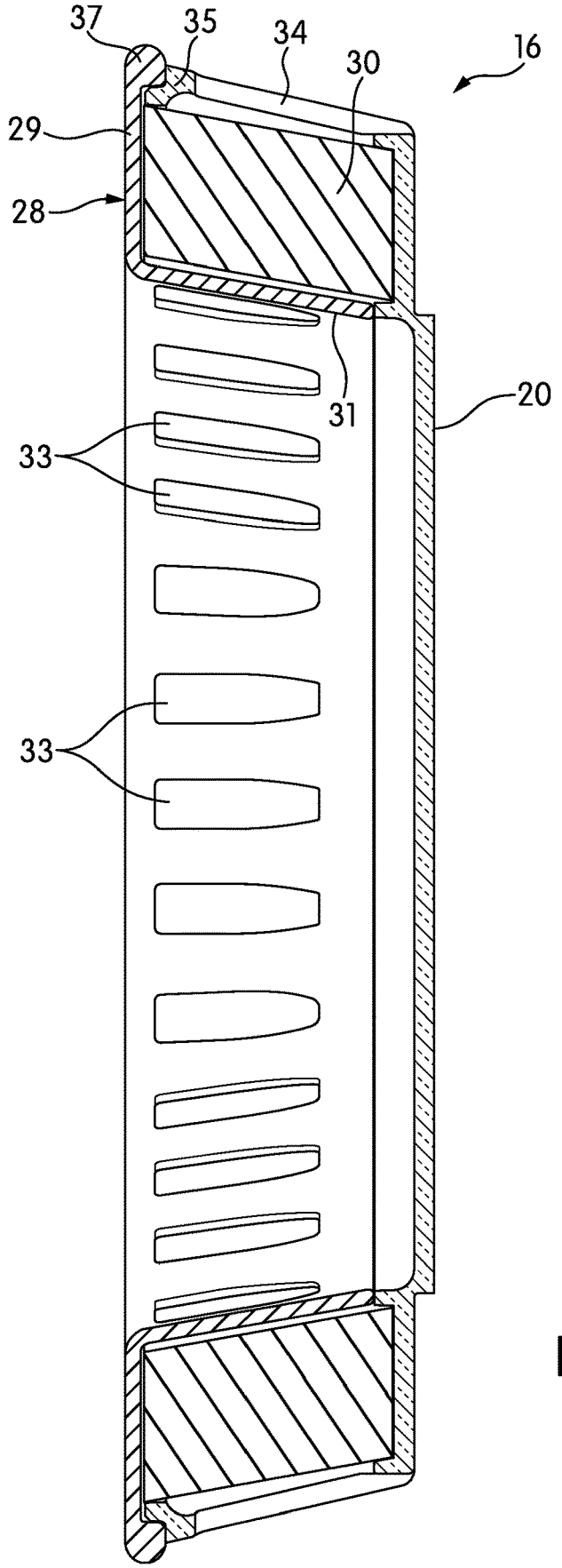
FIG. 4 is a cross-sectional view of a filter cartridge of the respirator mask of FIG. 1, taken through Line 4-4 of FIG. 3.

These components 28, 30, 32 can be better seen in FIG. 4, a cross-sectional view of the filter cartridge 16, taken through Line 4-4 of FIG. 3. The inner frame 28 has a hexagonal-annular lip 29 on which the filter medium 30 rests, and a portion 31 that extends upwardly along the inner side of the filter medium 30. The outwardly-extending portion 31 of the inner frame 28 has openings 33 that expose the inside of the filter medium 30 as much as possible to incoming and outgoing air.

The filter medium 30 of this embodiment traverses the entire perimeter of the filter cartridge 16, and thus, the perimeter of the mask portion 12. The outer frame 32 has a series of openings 34 along its outer periphery, exposing the outside of the filter medium 30 as much as possible. Other types and styles of perforation in the inner and outer frames 28, 32 are possible. The outer frame 32 is also configured to extend down over the filter medium 30 and rest with its lower edge 35 on the outer, upper edge 37 of the lip 29 of the inner frame 28. The two edges 35, 37 are complementary in shape to one another. Typically, the three components 28, 30, 32 are potted together with a resin poured on at least the lip 29 of the inner frame 28. In some cases, the three components 28, 30, 32 may be potted on both the front and back sides. The purpose of the base plate 28 and the outer frame 32 is to protect the filter medium 30 and allow it to retain its shape. The supportive structures that do so may vary from embodiment to embodiment. The filter cartridge 16 may be designed to be disposable, while other components of the respirator mask 10 are designed to be re-used and to be disinfected or sterilized as needed.

In the illustrated embodiment, the filter medium 30 itself is a particulate filter medium, and more particularly, a pleated filter medium. It has the shape of a generally hexagonal annulus. The filter medium itself may be, e.g., a PVDF, PTFE, or PEEK filter medium, pleated in M-pleats for maximum area. The material of which the filter medium is made may vary considerably from embodiment to embodiment. If the filter 16 is to be autoclaved, then its filter medium 30 should be made of a material that can withstand higher temperatures. If the filter cartridge 16 is disposable or does not need to withstand chemical disinfection, the filter medium may be made of more prosaic materials, like PET or polypropylene.

The precise characteristics of the filter cartridge 16 and its filter medium 30 may vary somewhat from embodiment to embodiment. Generally speaking, the filter cartridge 16 should be configured to ensure the maximum possible airflow while filtering the desired size and volume of particulates. NIOSH standards for an N95 mask require a respirator mask to supply at least 85 L/min of air with a pressure drop of not more than 20 $mmH_2O$. Respirator masks 10 according to embodiments of the invention are preferably capable of supplying more air with less pressure drop and, in some cases, a higher filter rating. For example, an embodiment of the invention may supply 4 cubic feet per minute (CFM; 113 L/min) of air with a pressure drop of about 5 $mmH_2O$ at an N100 filter rating. As those of skill in the art will understand, while the NIOSH standards are instructive, 85 L/min is a relatively low airflow rate, and active individuals may require both a higher airflow rate and a lower pressure drop to feel comfortable using the respirator mask 10.

Additionally, while the respirator mask 10 uses a modular filter cartridge 16 to contain its filter medium 30, a filter medium need not be contained within a modular filter cartridge 16. In that case, the filter medium itself would traverse the perimeter or periphery of whichever component or components house it.

Meanwhile, the inner seal 22 and bezel 18 are preferably structured such that air can essentially only enter the mask portion 12 through the filter cartridge 16. Here, the term "essentially only" refers to a design in which there is no deliberate or planned way for air to enter the mask portion 12 except through the filter cartridge 16, although there may be some unintended leakage. Much unintended leakage can be prevented by fitting a wearer with the correct size of mask portion 12 and training the wearer to use it properly. In some cases, the mask portion 12 may have a valved exhaust for exhaled air; however, in most cases, the exhaust air may simply exit the mask portion 12 through the filter cartridge 16.

The natural consequence of the design of the mask portion 12 illustrated in FIGS. 1-3 is that air enters and exits the mask portion 12 along its peripheral sides, where the openings 33, 34 in the inner and outer frames 28, 32 of the filter cartridge 16 allow the air to enter and leave. The filter medium 30 is arranged within the filter cartridge 16 to present its maximum filter area to air entering through the peripheral sides, along the defined air path. However, with respect to incoming air, a filter cartridge could be constructed and arranged to allow air intake along any side or aspect. Outgoing, exhaled air may leave the mask portion 12 through the same path as incoming air. If a valved exhaust is provided, it is desirable to direct the air so that it does not blow directly at nearby people, but the location of the exhaust is otherwise not critical.

As was described briefly above, the filter cartridge 16 with its pleated filter medium 30 is a particulate filter cartridge 16. In other embodiments, the filter cartridge may be chemical vapor or gas filter, in which case, inside a ventilated cartridge, a chemical absorbant, adsorbant, or reactant would be present. In yet other embodiments, the filter cartridge may comprise both a particulate filter medium and a chemical absorbant, adsorbant, or reactant.

As shown in FIG. 3, the filter cartridge 16 carries the front panel 20, such that the bezel 18 acts only as a splash guard, clamp, and connection point for the headgear 14. The front panel 20 may be molded into the filter cartridge 16 as, e.g., an integral part of the outer frame 32. While the front panel 20 may be a separate component in some embodiments, integrating the front panel 20 into the filter cartridge 16 eliminates the need for sealing structure between the front panel 20 and the filter cartridge 16.

The bezel 18 extends rearwardly over the filter cartridge 16 and protects at least a portion of the filter medium 30 from fluid droplets and other particles. With the bezel 18 installed, the filter medium 30 is exposed to the outside along a slit 19 that traverses the perimeter of the mask portion 12. Overall, the arrangement of the filter cartridge 16 and bezel 18 minimize the number of seals, and thus, the number of potential failure points.

As shown in FIGS. 1-3, two clips 36 attach to the sides of the bezel 18 via sets of openings 38 in the sides of the bezel 18 and corresponding fasteners 40 on the clips 36. The fasteners 40 of FIG. 3 are push-in rivets or so-called Christmas-tree fasteners, although a variety of different fasteners may be used. A variety of other techniques may be used to bind the clips 36 to the bezel 18, including adhesive bonding, fusing, ultrasonic welding, and the like.

The headgear 14 includes a head strap 42, a neck strap 44, and an elongate, extensible member 46 that ties the headgear 14 together. The head strap 42 of the illustrated embodiment is designed to rest on the rear upper portion of the head, as can be seen in FIGS. 1-2. It is wide and relatively flat to distribute force over a broader area, and in this embodiment, the center section of the strap 42 is divided into two legs 48 that diverge from one another and rejoin one another toward the edges of the strap 42. The neck strap 44 is in two parts, and is intended to rest against the back of the neck, as can be seen in FIGS. 1-2.

The elongate, extensible member 46 is in a single continuous piece. In various embodiments, the elongate, extensible member 46 may be an elastomeric cord; tubing; a wide, flat strap; or anything else that can perform the function of the elongate, extensible member 46. The elongate, extensible member 46 of the illustrated embodiment comprises flexible, extensible tubing that connects at one end to a pipe barb 48 carried at the forward end of the head strap 42, traverses down, through one clip 36, travels along the neck strap 44, passes through the second clip 36, and attaches to the second pipe barb 48 carried on the other side of the head strap 42. The elongate, extensible member 46 thus binds the head strap 42 and the neck strap 44 together as a collective whole, although in other embodiments, the two straps 42, 44 may be attached to the mask portion 12 by separate cords or other means.

Figure 5:
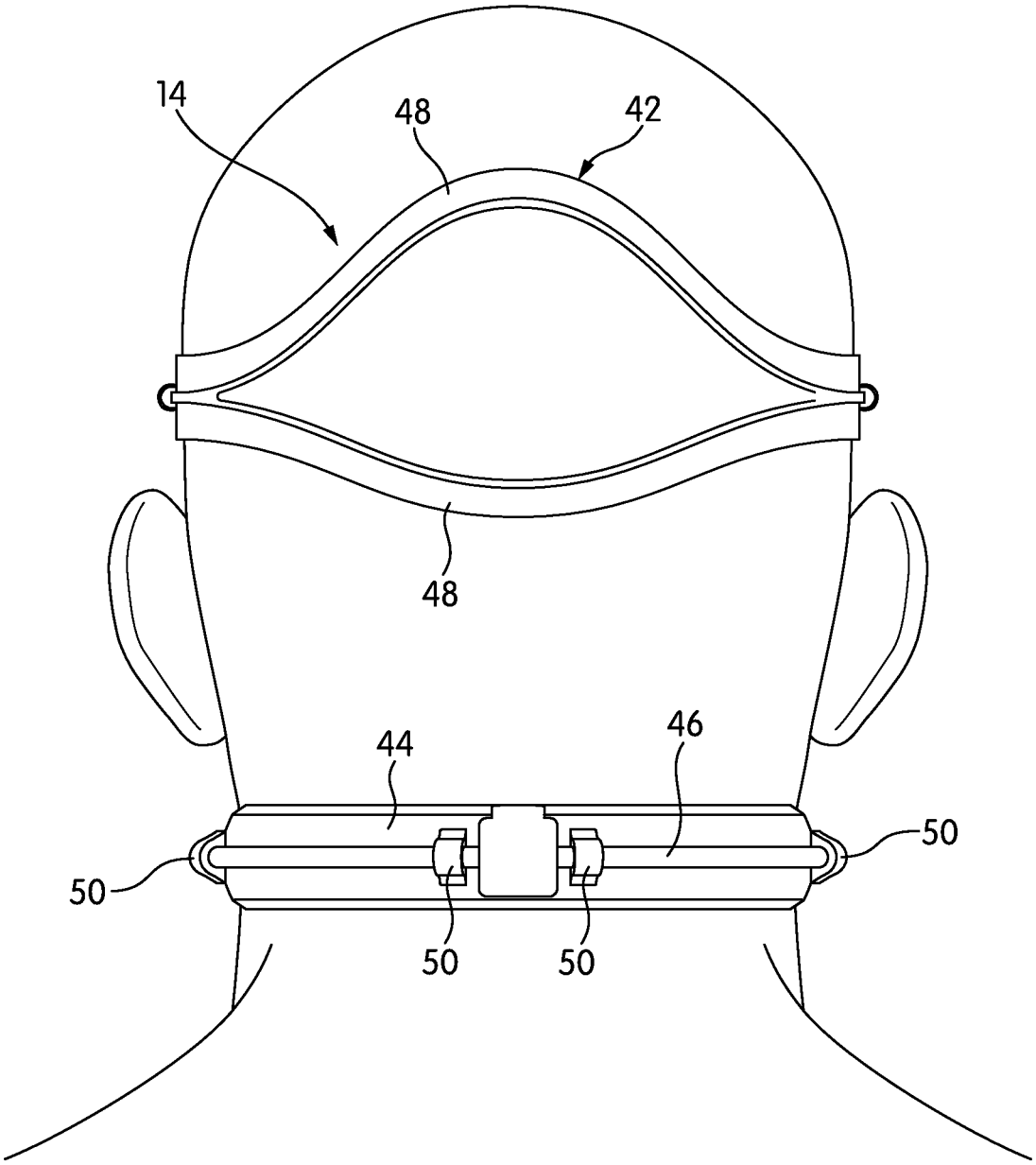
FIG. 5 is a rear elevational view of the respirator mask of FIG. 1, shown as installed on a wearer.

FIG. 5 is a rear elevational view of the respirator mask 10, illustrating the arrangement of the headgear 14. In particular, as shown in FIG. 5, the side and rear aspects of the neck strap 44 have a number of loops 50 through which the elongate, extensible member 46 passes.

While the features of the headgear 14 may vary from embodiment to embodiment and need not be what is illustrated in the figures, the headgear 14 does have certain advantages. One advantage is visible particularly in the view of FIG. 1—the position of the pipe barbs 48 that connect the elongate, extensible member 46, and the position of the clips 36 tends to hold or cant the elongate, extensible member 46 away from the face for greater comfort in wearing the respirator mask 10. In general, the respirator mask 10 is designed to be donned or doffed quickly, using a single hand if needed. Additionally, each portion of the headgear 14 is tailored for its purpose: the wide, flat straps 42, 44 at the head and neck distribute pressure easily, while the elongate, extensible member 46 can twist without interfering with the fit of the respirator mask 10, whereas a conventional flat strap might flip or twist and require untangling or make the fit uncomfortable.

Figure 6:
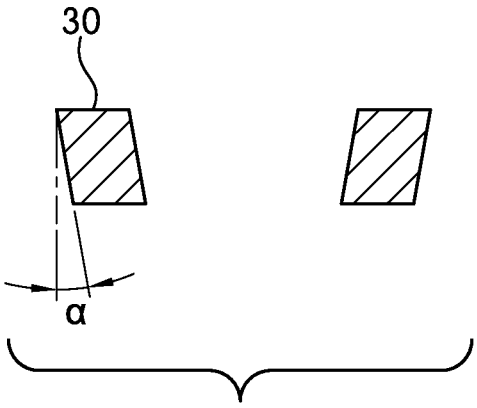
FIGS. 6 and 7 are cross-sections of filter media according to embodiments of the invention, illustrating various shapes for a filter medium.
Figure 7:
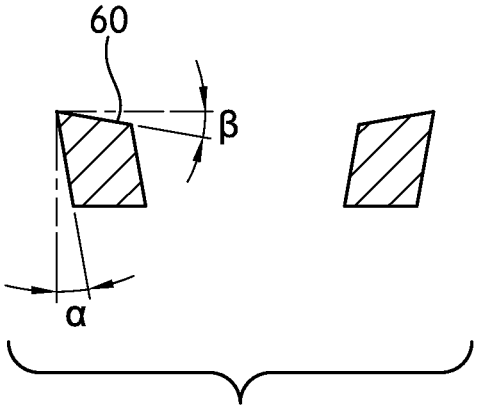

For many reasons, it is desirable to make the mask portion 12 as thin as possible in the front-to-back direction, and to give it as low a profile as possible. The thickness and profile of the mask portion 12 is influenced by several factors, one of which is the shape of the filter medium 30 itself. FIG. 6 is a cross-section of the filter medium 30 itself, in isolation. As shown in FIG. 6, the filter medium 30 is canted at an angle $\alpha$, such that has the cross-section of a parallelogram. In other embodiments, the filter medium may be shaped, angled, or tapered along multiple planes. FIG. 7 shows a filter medium 60 of a different configuration. The filter medium 60 of FIG. 7 is angled in two planes, making angles $\alpha$ and $\beta$.

Preferably, the materials of which the respirator mask and its components are made can resist at least some cleaning, chemical disinfection, or sterilization processes. These processes include autoclaving and chemical disinfection. For example, the non-disposable components of the respirator mask 10 may be made to resist 400 autoclaving cycles of up to 130° C. if they are intended to be autoclaved, and chemicals such as alcohol, bleach, hydrogen peroxide, glutaraldehyde, OPA, and peracetic acid if chemical disinfection is intended.

Figure 8:
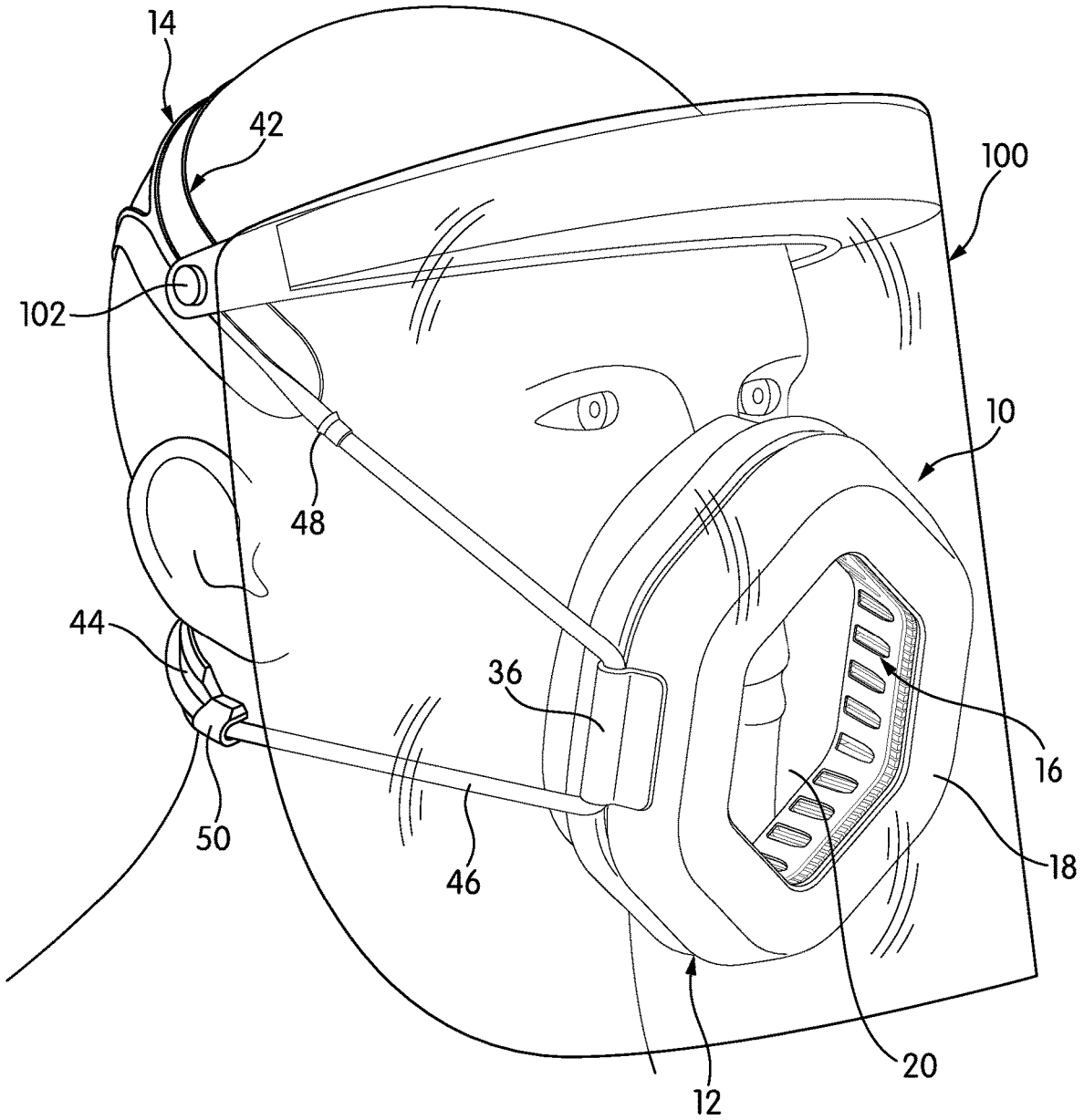
FIG. 8 is a perspective view of the respirator mask of FIG. 1 with a full-face shield.

The respirator mask 10 may be used with a wide variety of accessories, which may be separate from the respirator mask 10 and used in conjunction with it, or may be integrated into or connected to the respirator mask 10. As one example, FIG. 8 is a perspective view similar to the view of FIG. 1. In the view of FIG. 8, the respirator mask 10 includes a full-face shield 100 that is pivotably secured to the head strap 42 on each side by rivets 102 or other fasteners that allow the full-face shield 100 to pivot up and out of the way.

Figure 9:
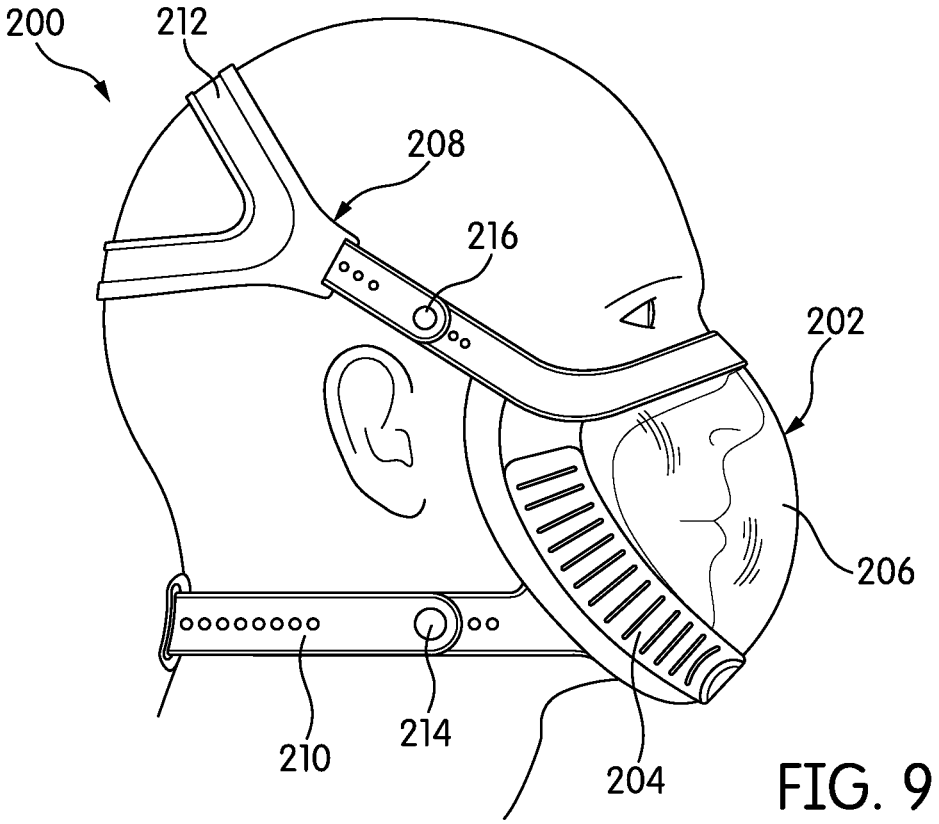
FIG. 9 is a side elevational view of a respirator mask according to another embodiment of the invention.
Figure 10:
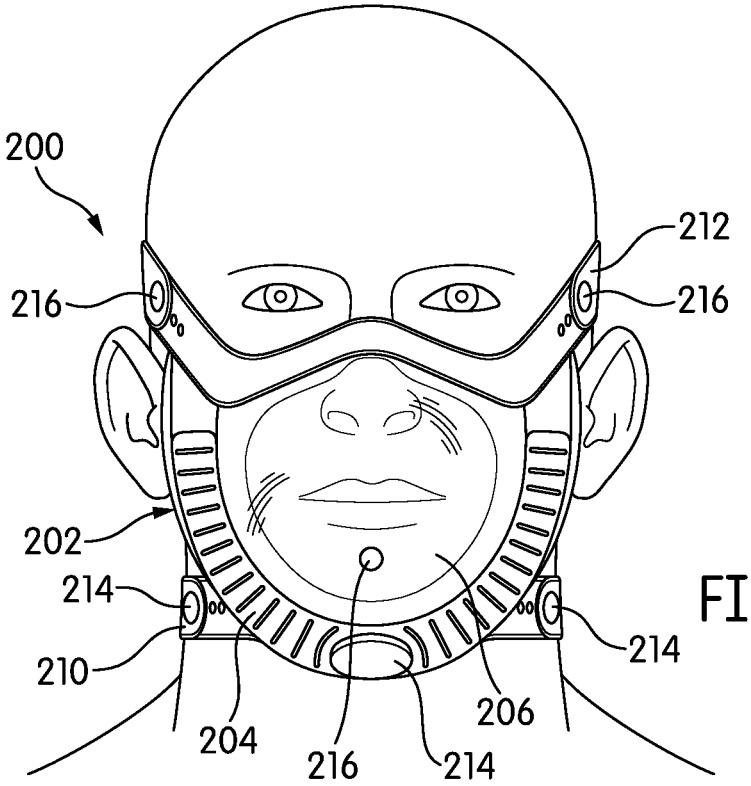
FIG. 10 is a front elevational view of the respirator mask of FIG. 9.

Respirator masks may be implemented in various ways according to embodiments of the invention. FIGS. 9 and 10 are side and front elevational views of a respirator mask, generally indicated at 200, according to another embodiment of the invention.

Like the embodiment described above, the respirator mask 200 of FIGS. 9-10 has a mask portion 202 that uses a pleated particulate filter 204. The pleated particulate filter 204 traverses the perimeter of the mask portion 202, leaving the nose and mouth unobstructed. This respirator mask 200 also has a transparent front 206. However, the shape of the mask portion 202 is significantly different than that of the respirator mask 10 described above. In particular, the overall shape of the mask portion 202 is more rounded, and the front 206 is curved, bulging out to accommodate the nose and sweeping back toward the face as it extends toward the chin.

In this case, the filter 204 is U-shaped, inserting into the lower, U-shaped portion of the mask portion 202. Moreover, in contrast to the respirator mask 10 described above, the filter 204 of this mask portion 202 does not traverse the entirety or substantially the entirely of the mask's perimeter; rather, it extends only around the lower, U-shaped section of the mask portion 202. The extent of the filter in any given embodiment, i.e., precisely how much of the perimeter or periphery of the respirator mask it extends over, will depend on the characteristics of the filter (i.e., air flow, pressure drop, etc.). If a filter that extends over a smaller portion of the perimeter (e.g., 10%, 25%) of the respirator mask can provide an adequate airflow with a sufficiently low pressure drop given a particular filter rating, that smaller filter can be used.

The respirator mask 200 also has headgear 208, which includes a neck strap 210 and a head strap 212. Both straps 210, 212 are wide, flat straps with lengths that are adjusted using buckles.

The respirator mask 200 of FIGS. 9 and 10 has other useful features, including a plate 214 on its bezel that can bear indicia of the wearer's identity or role, and a port 216 in the front 206 that would allow for the insertion of a straw for drinking. The port 216 may include a seal, such as an o-ring, around it, in order to make a seal against the inserted straw.

The embodiments of respirator masks 10, 200 described here have headgear 14, 208 that fit the wearer in different ways. The respirator mask 10 of FIGS. 1-8 primarily relies on the resilient stretch of its headgear 14, and particularly, the resilient stretch of the elongate, extensible member 46, to provide a good fit for wearers with heads of different sizes. The respirator mask 200 of FIGS. 9-10 uses headgear 208 with buckled straps 208, 210 that rely on a combination of adjustable strap length and resilient stretch of the straps 208, 210 to ensure a good fit.

In the respirator mask 200 of FIGS. 9-10, both straps 210, 212 have length adjustment mechanisms 214, 216, on both sides of the head. In the adjustment mechanism 216 of the head strap 212, the extra strap material doubles back over itself to form a so-called "service loop" of material. While the arrangement of FIGS. 9-10 is certainly a useful way to provide for length adjustment of straps, the number of adjustment points may prove unwieldy for at least some wearers. On the other hand, relying entirely on the elasticity of the components of the headgear 14 may mean that some wearers feel more pressure than others from the straps 42, 44, or that there is some range of head sizes that the headgear 14 simply cannot accommodate.

The headgear 14 of the respirator mask 10 has a specific advantage with respect to adjustment: because the head strap 42 and the neck strap 44 are joined together as one continuous piece by the elongate, extensible member 46, a single fit-adjustment mechanism located in a single position may be sufficient to fit the headgear 14 properly to a wearer. Ideally, a respirator mask according to an embodiment of the invention can be fit once and then slipped on and off without needing to change the fit.

Figure 11:
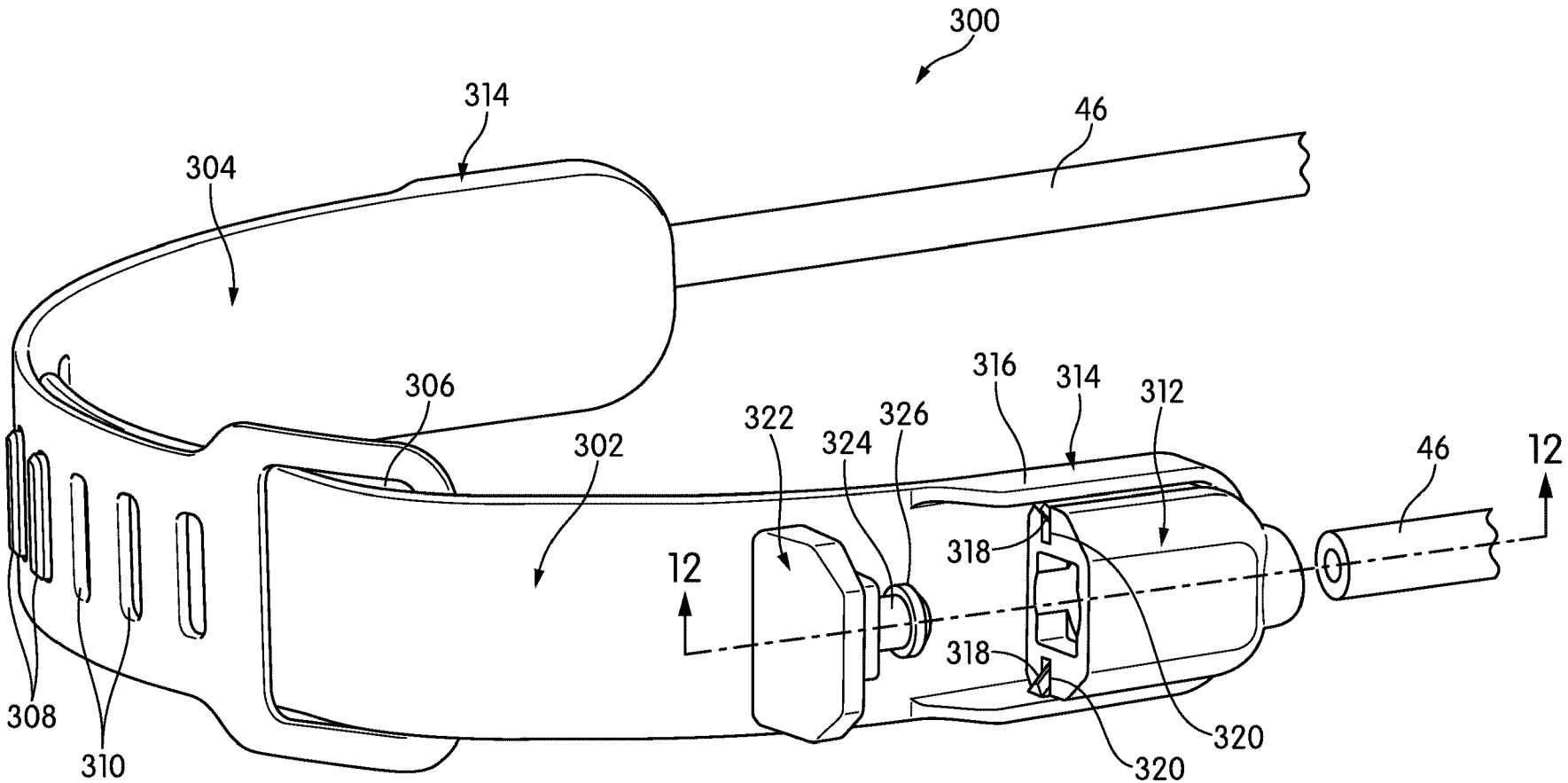
FIG. 11 is a partially exploded perspective view of a neck strap according to another embodiment of the invention, illustrating a quick-disconnect mechanism for respirator mask headgear.

FIG. 11 is a partially exploded perspective view of a neck strap 300 in isolation, illustrating an adjustment and disconnection mechanism for headgear, according to another embodiment of the invention. The neck strap 300 is comprised of two complementary parts 302, 304. The first part 302 inserts into a buckle-like opening 306 in the second part 304 and slides behind the second part 304. The first part 302 has a projection or projections 308 that snap into complementary openings 310 in the second part 304. Thus, the functional length of the neck strap 300 can be chosen by selecting which of the plurality of openings 310 the projections 308 snap into. Because the neck strap 300 is contiguously connected with the rest of the headgear, changing the functional length of the neck strap 300 changes the fit of the headgear. Of course, a head strap could also carry a length-adjustment mechanism, as shown in FIGS. 9 and 10.

The neck strap 300 also has a quick-connect anchor system for the elongate, extensible member 46. More specifically, as will be described below in more detail, the elongate, extensible member 46, which comprises tubing in this embodiment, as above, is received in an anchor member 312. That anchor member 312 connects to an anchorage 314 provided at the distal end of the neck strap 300.

The anchorage 314 has a U-shaped wall 316 that arises from the neck strap 300 and extends around three sides of the neck strap 300. In FIG. 11, the U-shaped wall 316 arises gradually from the neck strap 300, sloping gradually up to its full height, but that need not always be the case. On the two opposed sides of the U-shaped wall 316, inwardly-extending flanges 318 are provided at a height that is a portion of the height of the U-shaped wall 316. The anchor member 312 has grooves or channels 320 that receive the inwardly-extending flanges 318. The anchor member 312 receives the tubular elongate, extensible member 46 in one end, and has a retaining member 322 that enters the anchor member 312 from the other end to retain the elongate, extensible member 46.

Figure 12:
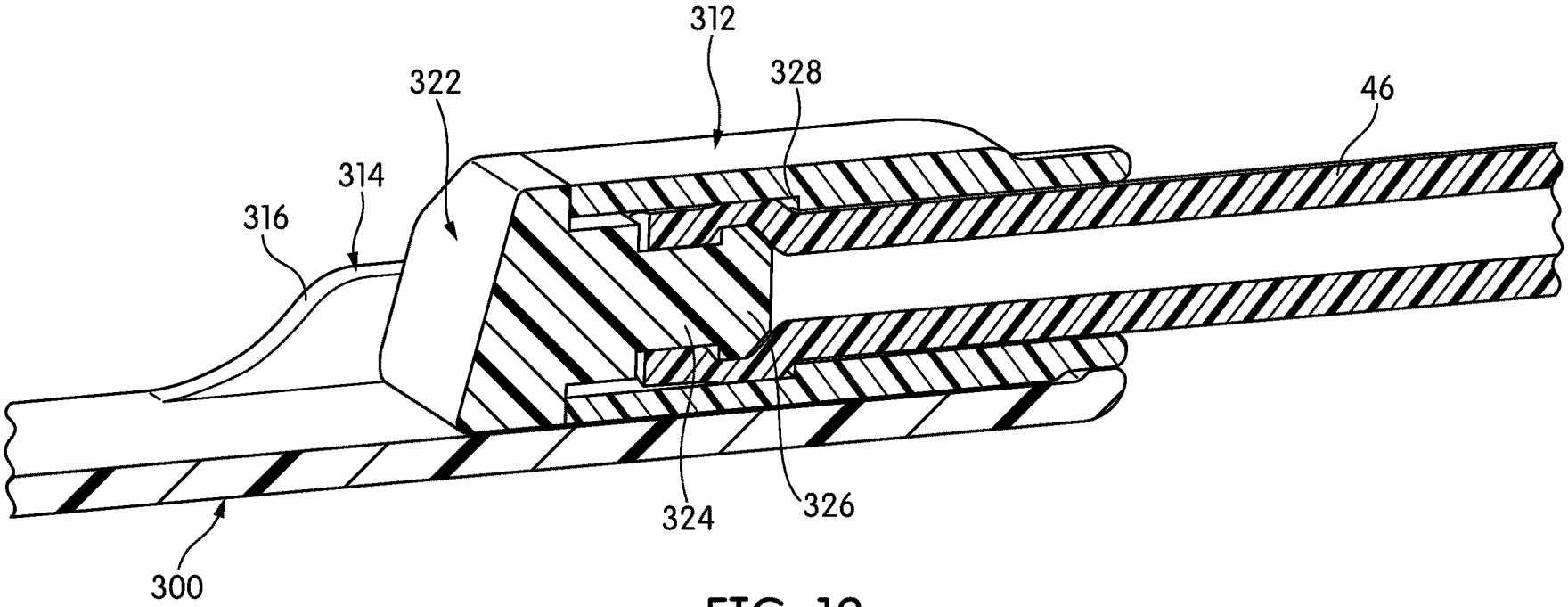
FIG. 12 is a cross-sectional view taken through Line 12-12 of FIG. 11.

FIG. 12 is an assembled cross-sectional view of the anchor member 312 showing the retaining member 322 engaged with the elongate, extensible member 46. The retaining member 322 has a tubular portion 324 that is sized to insert into the elongate, extensible member 46. The tubular portion 324 terminates in at least one barb 326, although several barbs 326 may be used in series in some embodiments. Thus, the connection between the anchor member 312 and the elongate, extensible member 46 is a barbed connection, like the connection described above. However, that connection is internal to the anchor member 312. The anchor member 312 also has additional features that help to secure the two components 46, 322. Specifically, the anchor member 312 has a step reduction in internal height or diameter, indicated at 328. The step reduction 328 is positioned just forward of the tip of the barb 326, so that the barb 326 drives the walls of the tubular, elongate, extensible member 46 outward just behind the step reduction 328 in the height or diameter of the anchor member 312. This engagement helps to retain the elongate, extensible member 46 within the anchor member 312.

As may be apparent from the above description, the anchor member 312 can be pushed rearwardly, or the neck strap 300 forwardly, in order to quickly remove the anchor member 312 from its anchorage 314. This serves as a quick-disconnect mechanism that allows the headgear of the respirator mask, properly adjusted in length for its wearer, to be quickly disconnected so that the respirator mask can be easily donned and doffed. Of course, as those of skill in the art will realize, FIGS. 10 and 11 illustrate only one possible type of quick-disconnect anchorage; other types of anchorages that rely on a button or other type of actuator may be used.

A single anchor member 312 and anchorage 314 may be sufficient for the reasons described above. However, even if a single such mechanism is sufficient, it may be advantageous to provide one on each side of the neck strap 300, so that the headgear can be quickly and easily disengaged using either the left hand or the right hand. FIG. 11 shows an anchorage 314 on the opposite side of the neck strap 300. Moreover, while the anchorage 314 for the quick-release mechanism is shown on a neck strap 300, such anchorages 314, and other quick-release mechanisms, may also be carried by the head strap. Furthermore, there is no requirement that the length adjustment mechanism and the quick-release mechanism, if any, be carried by the same strap. In some embodiments, the head strap may include a length-adjustment mechanism and the neck strap may carry a quick-release mechanism but no length-adjustment mechanism. Finally, although the respirator masks 10, 200, 300 shown here all use two straps, one for the head and one for the neck, respirator masks according to other embodiments of the invention may use only a single strap.

Although portions of this description may focus on medical applications, respirator masks according to embodiments of the invention could be used in general industrial settings as well, either as particulate respirators or as chemical/gas respirators if the filter is equipped for chemical/gas filtration. As those of skill in the art will appreciate, filter-change schedules and other operating procedures may be different in medical and industrial contexts.

While the invention has been described with respect to certain embodiments, the description is intended to be exemplary, rather than limiting. Modifications and changes may be made within the scope of the invention, which is defined by the appended claims.

What is claimed is:

1. A respirator mask, comprising:

sealing structure arranged to seal around at least a nose and mouth of a wearer;

a filter cartridge operatively coupled to a front of the sealing structure and configured such that air essentially only enters the respirator mask through the filter cartridge, the filter cartridge including a pleated particulate filter medium and a transparent front cover, the filter cartridge, having the pleated particulate filter medium and the transparent front cover, configured to be removable, the filter medium extending around a perimeter of the filter cartridge, an arrangement of the sealing structure and a portion of the filter cartridge leaving a central area of the respirator mask unobstructed, the central area defined so as to coincide with at least the mouth of the wearer when the respirator mask is worn;

the transparent front cover sealed over the central area;

a bezel adapted to be releasably attached to a front of the filter cartridge to cover at least a portion of the filter cartridge, the bezel having an opening, wherein the opening coincides with the transparent front cover and leaves the transparent front cover exposed so that at least the mouth of the wearer is visible when the respirator mask is worn; and strap structure adapted to hold the respirator mask in place on a face.

2. The respirator mask of claim 1, the filter cartridge comprising:

a perforated inner frame arranged to support the filter medium along an inner aspect thereof; and a perforated outer frame arranged to support the filter medium along an outer aspect thereof, the inner frame and the outer frame being connected together.

3. The respirator mask of claim 1, wherein the bezel covers at least a perimeter of the transparent front cover and extends rearwardly over the filter cartridge.

4. The respirator mask of claim 1, wherein the bezel carries connecting structure for the strap structure.

5. The respirator mask of claim 4, wherein the strap structure holds the bezel in place over the filter cartridge.

6. The respirator mask of claim 1, the strap structure further comprising:

a head strap;

a neck strap; and an elongate, extensible member connecting the head strap and the neck strap.

7. The respirator mask of claim 6, the strap structure further comprising:

a length-adjustment mechanism in the head strap or the neck strap; and a quick-release mechanism in the head strap or the neck strap.

8. The respirator mask of claim 7, the quick release mechanism further comprising:

an anchorage; and an anchor that receives the elongate, extensible member;

wherein the anchor and the anchorage include complementary engaging structure adapted to allow the anchor and the anchorage to releasably engage one another.

9. The respirator mask of claim 1, wherein the filter medium traverses an entire perimeter of the filter cartridge.

10. The respirator mask of claim 1, wherein the filter medium is shaped, angled, or tapered along multiple planes.

11. The respirator mask of claim 1, further comprising a face shield.

12. The respirator mask of claim 11, wherein the face shield is attached to the strap structure.

* * * * *